US010995390B2

(12) United States Patent
Gallitognotta et al.

(10) Patent No.: US 10,995,390 B2
(45) Date of Patent: May 4, 2021

(54) NON-EVAPORABLE GETTER ALLOYS PARTICULARLY SUITABLE FOR HYDROGEN AND CARBON MONOXIDE SORPTION

(71) Applicant: Saes Getters S.p.A., Lainate (IT)

(72) Inventors: Alessandro Gallitognotta, Origgio (IT); Alberto Coda, Gerenzano (IT)

(73) Assignee: Saes Getters S.p.A., Lainate (IT)

( * ) Notice: Subject to any disclaimer, the term of this patent is extended or adjusted under 35 U.S.C. 154(b) by 53 days.

(21) Appl. No.: 16/086,168

(22) PCT Filed: May 25, 2017

(86) PCT No.: PCT/EP2017/062707
§ 371 (c)(1),
(2) Date: Sep. 18, 2018

(87) PCT Pub. No.: WO2017/203015
PCT Pub. Date: Nov. 30, 2017

(65) Prior Publication Data

US 2019/0360076 A1 Nov. 28, 2019

(30) Foreign Application Priority Data

May 27, 2016 (IT) ..... UA2016A003861

(51) Int. Cl.

| | |
|---|---|
| ***C22C 16/00*** | (2006.01) |
| ***B22F 1/00*** | (2006.01) |
| ***C22C 1/04*** | (2006.01) |

(52) U.S. Cl.
CPC ..... *C22C 16/00* (2013.01); *B22F 1/0011* (2013.01); *C22C 1/0458* (2013.01); *B22F 2301/205* (2013.01)

(58) Field of Classification Search
None
See application file for complete search history.

(56) References Cited

U.S. PATENT DOCUMENTS

| | | | |
|---|---|---|---|
| 4,839,085 | A | 6/1989 | Sandrock et al. |
| 9,416,435 | B1 | 8/2016 | Coda et al. |
| 2008/0028931 | A1 | 2/2008 | Coda et al. |
| 2014/0252266 | A1 | 9/2014 | Coda et al. |

FOREIGN PATENT DOCUMENTS

| | | | |
|---|---|---|---|
| WO | WO 2015/075648 | A1 | 5/2015 |

OTHER PUBLICATIONS

International Search Report and Written Opinion dated Jul. 4, 2017, in PCT/EP2017/062707 filed May 25, 2017.

*Primary Examiner* — Xiaobei Wang
(74) *Attorney, Agent, or Firm* — Oblon, McClelland, Maier & Neustadt, L.L.P.

(57) ABSTRACT

Getter devices with improved sorption rate based on powders of ternary alloys particularly suitable for hydrogen and carbon monoxide sorption are described, said alloys having a composition comprising zirconium, vanadium and aluminum as main constituent elements.

18 Claims, No Drawings

NON-EVAPORABLE GETTER ALLOYS PARTICULARLY SUITABLE FOR HYDROGEN AND CARBON MONOXIDE SORPTION

The present invention relates to new getter alloys having an increased hydrogen and carbon monoxide sorption performance at low operating temperature, to a method for sorbing hydrogen with said alloys and to getter devices which employ said alloys for the removal of hydrogen.

The alloys which are the subject-matter of this invention are particularly useful for all the applications which require manufacturing or operating conditions incompatible with the required thermal activation temperature typical of getter alloy in the prior-art having high sorption rate of significant quantities of both hydrogen and carbon monoxide Among the most interesting applications for these new sorbing alloys there are vacuum insulating panels, vacuum pumps and gas purifier.

The use of getter materials for hydrogen removal in these applications is already known, but the currently developed and used solutions are not suitable for meeting the requirements which are imposed by the continuous technological developments which set more and more rigid limits and constraints.

In some particular applications in the field of vacuum insulating panels, as for example thermal bottles, pipes for oil and gas, collecting solar panels, evacuated glasses, getter alloys are required to effectively sorb hydrogen and carbon monoxide when temperature is in the range comprised between room temperature (RT) and 300° C.

Another applicative field which can benefit from the use of getter alloys capable of hydrogen sorption at high temperatures is that of getter pumping elements in vacuum pumps. This type of pumps is described in various patent documents, such as U.S. Pat. Nos. 5,324,172 and 6,149,392, as well in the international patent publication WO 2010/105944, all in the name of the applicant. Being able to use the getter material of the pump at high temperature increases the performance thereof in terms of sorption capacity towards other gases; a main issue in this case is obtaining a high sorption rate when operating at a temperature in the range between RT and 300° C. as well as the capacity to obtain better device performances.

Another applicative field that benefits from the advantages of a getter material capable of hydrogen and carbon monoxide sorption with high sorption rate is the purification of the gases used in semiconductor industries. As a matter of fact, particularly when high flows are requested, typically higher than some l/min, the getter material has to quickly sorb gaseous species in order to remove gas contaminants such as $N_2$, $H_2O$, $O_2$, $CH_4$, CO, $CO_2$.

Two of the most efficient solutions for hydrogen removal are disclosed in EP 0869195 and in the international patent publication WO 2010/105945, both in the name of the applicant. The first solution makes use of Zirconium-Cobalt-Rare Earths (RE) alloys wherein RE can be a maximum of 10% and is selected among Yttrium, Lanthanum and other Rare Earths. In particular, the alloy having the following weight percentages: Zr 80.8%-Co 14.2% and RE 5%, has been particularly appreciated. Instead, the second solution makes use of Yttrium-based alloys in order to maximize the removable amount of hydrogen at temperatures above 200° C. although their properties of irreversible gas sorption are essentially limited with respect to the needs of many applications requiring vacuum conditions.

A particular solution, useful for quickly gettering hydrogen and other undesired gases such as CO, $N_2$ and $O_2$ is described in U.S. Pat. No. 4,360,445, but the oxygen-stabilized zirconium-vanadium-iron intermetallic compound disclosed therein can be successfully used in the particular range of temperature (i.e. −196° C. to 200° C.) only requiring a large amount of oxygen and therefore lowering the sorption capacity and rate per gram, i.e. limiting its field of possible application.

As alternative, U.S. Pat. No. 4,839,085 discloses non-evaporable getter alloys suitable to remove hydrogen and carbon monoxide focusing on a Zr-rich composition selected in the zirconium-vanadium-third element system, wherein the third element can be selected among nickel, chromium, manganese, iron and/or aluminum, the latest disclosed in the examples as preferably set as fourth element. Even if those alloys seem to be effective in making some steps in the manufacturing process easy, the absorption rate when exposed to $H_2$ and CO is not enough to be applied in many applications, as for example in getter pumps for high vacuum systems. Moreover, the non-evaporable getter alloys disclosed by U.S. Pat. No. 4,839,035 require a sintering process in the manufacturing of getter elements containing them, resulting in a further limitation that rules out most of the applications in the vacuum insulting field, in particular their use in thermal bottles.

Therefore improved characteristics of the alloys according to the present invention versus hydrogen and carbon monoxide have to be intended and evaluated in a twofold possible meaning, namely an increased sorption rate for $H_2$ and a low hydrogen equilibrium pressure when the operating temperature of said getter alloys is comprised in the range between RT and 300° C. For the most interesting alloys according to the present invention, this property should be considered and associated with an unexpected improved sorption performance with respect to other gaseous species and with particular reference to CO. Moreover, these alloys have shown lower activation temperatures and lower particle losses in combination with higher embrittlement and resistance to hydrogen cycling It is therefore an object of the present invention to provide a getter alloy suitable to be used in getter devices and capable of overcoming the disadvantages of the prior art. These objects are achieved by a a ternary non-evaporable getter alloy, preferably in form of a powder, having the following atomic percentage composition:

a. vanadium from 18 to 40%;

b. aluminum from 5 to 25%;

c. zirconium in the amount to balance the alloy to 100%;

namely wherein the atomic percentages are calculated with respect to the alloy.

Optionally, the non-evaporable getter alloy composition can further comprise, as additional compositional elements, one or more metals in an overall atomic concentration lower than 3% respect the total of the alloy composition. In particular, these one or more metals can be selected from the group consisting of iron, chromium, manganese, cobalt, and nickel in an overall atomic percentage preferably comprised between 0.1 and 2%. Contrary to the prior art, the inventors have found that these one or more metals can be contained in the alloy composition preferably in an amount lower than 10% of the aluminum atomic percentage content.

The present inventors have in fact surprisingly found that ternary alloys in the Zr—V—Al system have an improved $H_2$ and CO sorption rate when the aluminum amount is selected in the range comprised between 5 and 25%. Differently from U.S. Pat. No. 4,839,035, aluminum has been chosen as third element in the ternary alloy composition in place of other metals in the list of nickel, chromium, manganese and iron. More specifically, the inventors have found that a best improvement in the getter performance of alloys based on zirconium and vanadium can be found when aluminum is added in a significant amount (higher than 5% atomic percentage) and not as a minor component into a ternary system Zr-V-X where X=Ni, Cr, Mn or Fe in an amount lower than 7% atomic percent. In those disclosed compositions, in fact, when aluminum is used in association with another main third element, it is clear that its concentration should be significantly lower than the 5% atomic percentage that inventors have found as minimum for the present invention.

In a further aspect, the present inventors have found that an important technical property that can be used in order to have the best results in overcoming the drawbacks of the prior-art alloys is the atomic ratio Zr/V, that should be comprised between 1 and 2.5. In fact, when said ratio is comprised in the above range, inventors have found that the sorption performance of the alloy is not jeopardize by sintering processes as commonly happens for pre-existing alloys. Moreover, the sorption performances are particularly optimized also in terms of maximum hydrogen and carbon monoxide sorption capacities and sorption speeds when said ratio is comprised between 1.5 and 2.

Moreover, minor amounts of impurities of other chemical elements can be present in the alloy composition if their overall percentage, intended as the sum of the atomic percentage content of all these chemical elements, is less than 1% with respect to the total of the alloy composition.

These and other advantages and characteristics of the alloys and devices according to the present invention will be clear to those skilled in the art from the following detailed description of some not limiting embodiments thereof.

The non-evaporable getter alloys according to the present invention can be used in the form of compressed pills obtained by means of a powder compaction process. Powder compaction is the process of compacting alloy powder in a die through the application of high pressures. Typically the tools are held in the vertical orientation with the punch tool forming the bottom of the cavity. The powder is then compacted into a shape and then ejected from the die cavity. The density of the compacted powder in the resulting shape (commonly in the form of pill) is directly proportional to the amount of pressure applied. Typical compression pressures suitable to compact non-evaporable getter alloy according to the present invention can range from 1 tons/cm$^2$ to 15 tons/cm$^2$ (1.5 MPa to 70 MPa). Working with multiple lower punches can be sometimes necessary to obtain the same compression ratio across a compressed powder element requiring more than one level or height. A cylindrical pill is made by single-level tooling. A more complex shape can be made by the common multiple-level tooling.

For example, a cylinder or a board made by cutting an alloy sheet of suitable thickness can be obtained. For their practical use the devices must be positioned in a fixed position in the container that is to be maintained free from hydrogen. The devices could be fixed directly to an internal surface of the container, for example by spot welding when said surface is made of metal. Alternatively, the devices can be positioned in the container by means of suitable supports; the mounting on the support can be then carried out by welding or mechanical compression.

In another possible embodiment of a getter device, a discrete body of an alloy according to the invention is used, particularly for those alloys having high plasticity features. In this case the alloy is manufactured in the form of a strip from which a piece having a desired size is cut; the piece is then bent in its portion around a support in the form of a metal wire. Support may be linear but it is preferably provided with curves that help the positioning of piece, whose shaping can be maintained by means of one or several welding points in an overlapping zone, although a simple compression during the bending around the support can be sufficient considering the plasticity of these alloys.

Alternatively, other getter devices according to the invention can be manufactured by using powders of the alloys. In case powders are used, they preferably have a particle size lower than 500 μm, and even more preferably lower than 300 μm, in some applications being comprised between 0 and 125 μm. A device having the shape of a tablet with a support inserted therein can be made for example by compression of powders in a mold, having prepared said support in the mold before pouring the powder. Alternatively, the support may be welded to the tablet.

As another alternative, a device formed by powders of an alloy according to the invention pressed in a metal container can be easily obtained; the device may be fixed to a support, for example by welding the container thereto.

Another kind of device comprising a support can be manufactured starting from a metal sheet with a depression, obtained by pressing sheet in a suitable mold. Most of the bottom part of depression is then removed by cutting, obtaining a hole, and support is kept within the pressing mold so that depression can be filled with alloy powders which are then pressed in situ thus obtaining the device in which the powder package has two exposed surfaces for the gas sorption.

In the field of getter pumps, the main requirement achieved by the present invention is an effective hydrogen sorption even when operating at low temperatures if compared to typically used with other existing getter alloys, without affecting the getter material capacity of effectively sorbing also other gas impurities as well $N_2$, $H_2O$, $O_2$, $CH_4$, CO, $CO_2$ that could be possibly present in the chamber that is to be evacuated. In this case, all the alloys which are the subject-matter of the present invention have features that are advantageous in this application, whereby those having higher affinity toward several gas impurities are particularly appreciated. In particular, the inventors have found that these alloys have sorption performance for hydrogen and carbon monoxide that are less jeopardized by sintering process that is commonly used for getters elements for getter pumps or getter pumping cartridge used in combination with other pumping elements (as for example ion pumps).

Sintering is the process of compacting and forming a solid mass of material by heat and/or pressure without melting it to the point of liquefaction. The atoms in the materials diffuse across the boundaries of the particles, fusing the particles together and creating one solid piece.

In the most common getter pumps, discoidal getter elements are conveniently assembled in a stack to obtain an object with increased pumping performances. The stack may be equipped with a heating element coaxial to the supporting element and mounted on a vacuum flange or fixed in the vacuum chamber by means of suitable holders.

In all the devices according to the invention, the supports, containers and any other metal part which is not formed of an alloy according to the invention, is made of metals having a low vapor pressure, such as tungsten, tantalum, niobium, molybdenum, nickel, nickel iron or steel in order to prevent these parts from evaporating due to the high working temperature to which said devices are exposed.

The alloys useful for the getter devices according to the invention can be produced by melting the pure elements, preferably in powder or pieces, in order to obtain the desired atomic ratios. The melting must be carried out in a controlled atmosphere, for example under vacuum or inert gas (argon is preferred), in order to avoid the oxidation of the alloy which is being prepared. Among the most common melting technologies, but not limited to these, arc melting, vacuum induction melting (VIM), vacuum arc remelting (VAR), induction skull meting (ISM), electro slug remelting (ESR), or electron beam melting (EBM) can be used. As an example, polycrystalline ingots can be prepared by arc melting of appropriate mixtures of the high purity constituent elements in an argon atmosphere. The ingot can be milled with several methods, such as Hammermill, Impact Mill or with a traditional ball milling, under argon atmosphere and subsequently sieved to a desired powder fraction, usually of less than 500 μm or more preferably less than 300 μm. When powders according to the present invention are used in a getter device that is in a compressed form (for example pills), the atomic ratio between zirconium and vanadium is preferably comprised between 1.5 and 2.

The sintering or high pressure sintering of the powders may also be employed to form many different shapes such as discs, bars, rings, etc. of the non-evaporable getter alloys of the present invention, for example to be used within getter pumps. Moreover, in a possible embodiment of the present invention, sintered products can be obtained by using mixtures of getter alloy powders having a composition according to claim 1 optionally mixed with elemental metallic powders such as, for example, titanium, zirconium or mixtures thereof, to obtain getter elements, usually in the form of bars, discs or similar shapes as well described for example in EP 0719609. When powders according to the present invention are used in a getter device in a compressed and sintered form, the atomic ratio Zr/V between zirconium and vanadium is preferably comprised between 1 and 2.5.

In a second aspect thereof, the invention consists in the use of a getter device as described above for hydrogen and carbon monoxide removal. For example, said use can be directed to hydrogen and carbon monoxide removal from a closed system or device including or containing substances or structural elements which are sensitive to the presence of said gases. Alternatively, said use can be directed to hydrogen and carbon monoxide removal from gas flows used in manufacturing processes involving substances or structural elements which are sensitive to the presence of said gases. Hydrogen and carbon monoxide negatively affect the characteristics or performances of the device and said undesired effect is avoided or limited by means of at least a getter device containing a ternary non-evaporable getter alloy having the following atomic composition:

i. vanadium from 18 to 40% ii. aluminum from 5 to 25% iii. zirconium in the amount to balance the alloy to 100%;

namely wherein the atomic percentages are calculated with respect to the alloy.

Optionally, the non-evaporable getter alloy composition can further comprise as additional compositional elements one or more metals in an overall atomic concentration lower than 3% respect the total of the alloy composition, preferably lower than 10% of the aluminum atomic percentage concentration In particular, these metals can be selected from the group consisting of iron, chromium, manganese, cobalt, and nickel in an overall atomic percentage. Moreover, minor amounts of impurities consisting in other chemical elements can be present in the alloy composition if their overall percentage, intended as the sum of all these chemical elements, is less than 1% with respect to the total of the alloy composition.

The use according to the invention finds application by using the getter alloy also in the form of powder, of pills of compressed powders, laminated on suitable metal sheets or positioned inside one of the suitable containers, possible variants being well known to the person skilled in the art, and not only for sintered products In particular, inventors have found that the sorption performances are optimized also in terms of maximum hydrogen and carbon monoxide sorption capacities and sorption speeds when said ratio is comprised between 1.5 and 2.

Alternatively, the use according to the invention can find application by using the getter alloy in the form of sintered (or high-pressure sintered) powders, optionally mixed with metallic powders such as, for example, titanium or zirconium or mixtures thereof.

The considerations above regarding the positioning of the getter material according to the present invention are general and are suitable for the employment thereof independently of the mode of use of the material or of the particular structure of its container.

Non-limiting examples of hydrogen-sensitive systems which can obtain particular benefits from the use of the above-described getter devices are vacuum chambers, cryogenic liquids transportation (e.g. hydrogen or nitrogen), solar receivers, vacuum bottles, vacuum insulated flow lines (e.g. for steam injection), electronic tubes, dewars, etc. pipes for oil and gas, collecting solar panels, evacuated glasses.

Unless otherwise defined, all terms of art, notations and other scientific terminology used herein are intended to have the meanings commonly understood by those of skill in the art to which this disclosure pertains. In some cases, terms with commonly understood meanings are defined herein for clarity and/or for ready reference; thus, the inclusion of such definitions herein should not be construed to represent a substantial difference over what is generally understood in the art.

The terms "comprising", "having", "including" and "containing" are to be construed as open-ended terms (i.e. meaning "including, but not limited to") and are to be considered as providing support also for terms as "consist essentially of", "consisting essentially of", "consist of" or "consisting of".

The terms "consist essentially of", "consisting essentially of" are to be construed as a semi-closed terms, meaning that no other ingredients which materially affects the basic and novel characteristics of the invention are included (possible impurities may thus included).

The terms "consists of", "consisting of" are to be construed as a closed term.

The invention will be further illustrated by means of the following examples. These non-limiting examples illustrate some embodiments which are intended to teach the skilled person how to put the invention into practice.

EXAMPLES

Several polycrystalline ingots have been prepared by arc melting of appropriate mixtures of the high purity metallic constituent elements in an argon atmosphere. Each ingot has been then grinded by ball milling under argon atmosphere and subsequently sieved to the desired powder fraction, i.e. less than 300 μm.

1 g of each alloy listed in table 1 (see below) were pressed in a die in order to obtain the samples (pill) labeled as sample A, B, C (according to the present invention) and comparative samples labeled from 1 to 7.

TABLE 1

| | Zr | V | Al | Ni | Cr | Mn | Fe |
|---|---|---|---|---|---|---|---|
| Comparative 1 | 50 | 35 | — | 15 | — | — | — |
| Comparative 2 | 57 | 35.8 | — | 7.2 | — | — | — |
| Comparative 3 | 57 | 35.8 | — | — | 7.2 | — | — |
| Comparative 4 | 57 | 35.8 | — | — | — | 7.2 | — |
| Comparative 5 | 57 | 35.8 | — | — | — | — | 7.2 |
| Sample A | 52.5 | 32.3 | 15.2 | — | — | — | — |
| Sample B | 53 | 27 | 20 | — | — | — | — |
| Sample C | 58.5 | 34.5 | 7 | — | — | — | — |
| Comparative 6 | 63 | 17 | 20 | — | — | — | — |
| Comparative 7 | 40 | 20 | 40 | — | — | — | — |

They have been compared in their sorption performance versus hydrogen and carbon monoxide in form of getter powder compressed pills (diameter 10 mm and height 3 mm) and in form of sintered getter disk, obtained after press and pressing and sintering process Temperature lower than 1250° C.

The test for $H_2$ and CO sorption capacity evaluation is carried out on an ultra-high vacuum bench. The getter sample is mounted inside a bulb and an ion gauge allows to measure the pressure on the sample, while another ion gauge allows to measure the pressure upstream of a conductance located between the two gauges. The getter is activated with a radiofrequency oven at 500° C.×10 min; afterwards it is cooled and kept at 25° C. A flow of $H_2$ or CO is passed on the getter through the known conductance, keeping a constant pressure of $3\times10^{-6}$ torr. Measuring the pressure before and after the conductance and integrating the pressure change in time, the pumping speed and the sorbed quantity of the getter can be calculated. The recorded data have been reported in table 2 (for sintered disks) and in table 3 (for compressed pills).

TABLE 2

| | Sintered | |
|---|---|---|
| | $H_2$ sorption rate (l/s) | CO sorption rate (l/s) |
| Comparative 1 | 10.0 | 4.8 |
| Comparative 2 | 11.0 | 6.0 |
| Comparative 3 | 10.0 | 5.2 |
| Comparative 4 | 7.5 | 5.3 |
| Comparative 5 | 5.6 | 5.0 |
| Sample A | 19 | 8 |
| Sample B | 17 | 8 |
| Comparative 6 | 6.3 | 6.2 |
| Comparative 7 | 6.8 | 4.7 |

TABLE 3

| | Pills 10–3 | |
|---|---|---|
| | $H_2$ sorption rate (l/s) | CO sorption rate (l/s) |
| Sample A | 2 | 1.5 |
| Sample B | 1.7 | 1 |
| Sample C | 3.5 | 2.3 |
| Comparative 6 | 1.2 | 0.5 |
| Comparative 7 | 0.5 | 0.3 |

The invention claimed is:

1. Non-evaporable sintered getter alloy consisting of:

a. vanadium from 18 to 40% by atoms;

b. aluminum from 5 to 25% by atoms;

c. optionally one or more additional element selected from the group consisting of iron, chromium, manganese, cobalt, and nickel; and d. zirconium in the amount to balance the alloy to 100% by atoms, wherein, if present, said one or more additional element is in an amount comprised between 0.1 and 2.5% by atoms with respect to the alloy, said amount of the one or more additional element being lower than 10% of the aluminum atomic percentage content in the alloy;

wherein said non-evaporable sintered getter alloy has a CO sorption rate from 29% to 66% greater than the CO sorption rate of non-evaporable sintered getter alloys having higher or lower vanadium or aluminum content than the vanadium or aluminum content of the claimed non-evaporable sintered getter alloy.

2. The non-evaporable sintered getter alloy according to claim 1, wherein zirconium and vanadium have a ratio Zr/V of their respective atomic amount comprised between 1 and 2.5.

3. The non-evaporable sintered getter alloy according to claim 1, wherein, if present, said one or more additional element is in an amount comprised between 0.1 and 2% by atoms with respect to the alloy.

4. The non-evaporable sintered getter alloy according to claim 1, which is in the form of a sintered powder.

5. A sintered mixture comprising the non-evaporable sintered getter alloy of claim 4 and a metal powder.

6. The sintered mixture of claim 5, wherein the metal powder is at least one selected from the group consisting of metallic titanium powder and metallic zirconium powder.

7. The non-evaporable sintered getter alloy according to claim 4, wherein said powder has a particle size lower than 500 μm.

8. A getter device, comprising:

the sintered non-evaporable getter alloy according to claim 1.

9. The getter device according to claim 8, wherein zirconium and vanadium have a ratio Zr/V of their respective atomic amount comprised between 1.5 and 2.

10. Non-evaporable sintered getter alloy able to sorb CO at a rate of 8 l/s consisting of:

i) vanadium from 18 to 40% by atoms;

ii) aluminum from 5 to 25% by atoms;

iii) optionally one or more additional element selected from the group consisting of iron, chromium, manganese, cobalt, and nickel;

iv) impurities in an amount lower than 1% by atoms with respect to the alloy, v) zirconium in the amount to balance the alloy to 100% by atoms; and wherein, if present, said one or more additional element is in an amount comprised between 0.1 and 2.5% by atoms with respect to the alloy, said amount of the one or more additional element being lower than 10% of the aluminum atomic percentage content in the alloy.

11. The non-evaporable sintered getter alloy according to claim 10, wherein zirconium and vanadium have a ratio Zr/V of their respective atomic amount comprised between 1 and 2.5.

12. The non-evaporable sintered getter alloy according to claim 10, wherein, if present, said one or more additional element is in an amount comprised between 0.1 and 2% by atoms with respect to the alloy.

13. The non-evaporable sintered getter alloy according to claim 10, which is in the form of a sintered powder.

14. A sintered powder mixture comprising the non-evaporable sintered getter alloy of claim 13 and a metal powder.

15. The sintered powder mixture of claim 14, wherein the metal powder is at least one selected from the group consisting of metallic titanium powder and metallic zirconium powder.

16. The non-evaporable sintered getter alloy according to claim 13, wherein said powder has a particle size lower than 500 μm.

17. A getter device, comprising:

the non-evaporable sintered getter alloy according to claim 10.

18. The getter device according to claim 17, wherein zirconium and vanadium have a ratio Zr/V of their respective atomic amount comprised between 1.5 and 2.

* * * * *